US005720543A

United States Patent [19]

Sheps

[11] Patent Number: 5,720,543

[45] Date of Patent: Feb. 24, 1998

[54] PORTABLE FLASHLIGHT

[75] Inventor: Martin I. Sheps, Poway, Calif.

[73] Assignee: Diamondlight Industries, Inc., Costa Mesa, Calif.

[21] Appl. No.: 503,930

[22] Filed: Jul. 19, 1995

[51] Int. Cl.[6] ..... F21L 1/00; F21L 7/00

[52] U.S. Cl. ..... 362/196; 362/199; 362/200; 362/267

[58] Field of Search ..... 362/103, 196, 362/199, 267, 396, 399, 200

[56] References Cited

U.S. PATENT DOCUMENTS

| | | | |
|---|---|---|---|
| 1,327,017 | 1/1920 | Boltshauser | 362/196 |
| 2,125,038 | 7/1938 | Tompkins et al. | 240/10.66 |
| 2,282,167 | 5/1942 | Cullman | 240/10.69 |
| 3,428,800 | 2/1969 | Levin et al. | 240/41.3 |
| 3,543,016 | 11/1970 | Jones | 240/3 |
| 3,813,004 | 5/1974 | Andreaggi | 220/96 |
| 3,919,542 | 11/1975 | Castic | 240/41.55 |
| 4,286,311 | 8/1981 | Maglica | 362/205 |
| 4,337,759 | 7/1982 | Popovich et al. | 126/438 |
| 4,398,237 | 8/1983 | Doyel | 362/196 |
| 4,410,933 | 10/1983 | Blake | 362/371 |
| 4,451,871 | 5/1984 | Kirkley et al. | 362/103 |
| 4,504,889 | 3/1985 | Goldfarb | 362/200 |
| 4,635,171 | 1/1987 | Beiswenger | 362/200 |
| 4,755,921 | 7/1988 | Nelson | 362/307 |
| 4,788,632 | 11/1988 | Friedman | 362/200 |
| 4,951,183 | 8/1990 | Wang | 362/205 |
| 5,029,060 | 7/1991 | Aho et al. | 362/299 |
| 5,134,558 | 7/1992 | Williams | 362/263 |
| 5,150,966 | 9/1992 | Nelson | 362/337 |
| 5,171,086 | 12/1992 | Baloochi | 362/188 |
| 5,404,869 | 4/1995 | Parkyn, Jr. | 126/699 |
| 5,469,345 | 11/1995 | Pettersen et al. | 362/196 |

*Primary Examiner*—Ira S. Lazarus
*Assistant Examiner*—Matthew Spark
*Attorney, Agent, or Firm*—Stetina Brunda Garred & Brucker

[57] ABSTRACT

A portable flashlight includes a low-profile housing, and disposed within the housing a special lens, a power source, and a light source. The light source has a shoulder portion, and a lamp portion with a filament a controlled distance from the shoulder. A socket disposed inside the housing a controlled distance from the lens is sized to receive the shoulder portion of the light source. The socket inside end receives the light source, electrically connecting the light source to the power source. Tight control of the focal length provides a collimated beam of light from a low-profile housing. A preferred embodiment also includes a handle formed to the housing with a multi-position detent, operative as a carrying handle or as a support stand. A preferred embodiment further includes a housing having two halves that are releasably attached to each other by a camming mechanism, to provide easy access inside the housing. And a preferred embodiment includes a number of gasket seals to provide a substantially water-tight construction.

6 Claims, 4 Drawing Sheets

PORTABLE FLASHLIGHT

FIELD OF THE INVENTION

The present invention relates generally to a portable flashlight, and more particularly to a low-profile flashlight that also is waterproof and easily disassembled.

BACKGROUND OF THE INVENTION

Various portable lanterns and flashlights have been previously known. These devices are frequently used in outdoor activities, such as camping, hiking, or the like. Also, these devices are frequently used in emergency conditions (e.g., earthquakes, windstorms, floods, etc.) when electric power provided by utilities is lost. In addition, portable flashlights are used by security personnel at night (e.g., policemen, watch guards, etc.) to provide a light source for safety. Portable flashlights used outdoors, either for leisure activities or in emergency or for security, are desirably able to survive being immersed in or exposed to water.

The prior art has generally included heavy-duty flashlights and electric lanterns which were large and heavy, mainly due to the large battery or many batteries contained in the device. The prior art flashlights often produce beams which are not well collimated. Also, some prior art portable flashlights are not sufficiently water-tight to avoid damage if dropped in a stream or exposed to heavy rainfall. Further, at least some prior art flashlights have been difficult or cumbersome to disassemble and reassemble, usually requiring the removal of loose batteries and the screwing of threaded attachment members subject to wear.

Though the prior art has made some progress in providing more compact, lightweight, and all-around better functioning flashlights, the above-mentioned deficiencies of the prior art have yet to be fully addressed and remedied.

SUMMARY OF THE INVENTION

The present invention generally comprise a portable flashlight which includes a low-profile housing and, disposed within the housing, a lens, power source, and light source. The light source has a shoulder portion and a lamp portion. The lamp portion incorporates an illumination filament which is located a controlled distance from the shoulder portion. A socket is disposed inside the housing a controlled distance from the lens, and is sized to receive the shoulder portion of the light source. When the shoulder portion of the light source is received within the socket, an electrical connection is completed between the filament and the power source. Also, the filament is thereby located at a controlled distance from the lens. This control of the focal length provides a collimated beam of light from a low-profile housing.

The lens of the flashlight device of the present invention may comprise any suitable type of lens, including the lens described in U.S. Pat. No. 4,337,759 previously issued to Applicant.

In a preferred embodiment, the portable flashlight of the present invention may further comprise a handle formed on or connected to the housing with a multi-position detent mechanism which enables the handle to be rotated and converted into a stand to support the flashlight. The flashlight may further include a clip attached to the housing, to support the flashlight for attachment to an individual's clothing.

Also in a preferred embodiment of the invention, the housing may be formed in two halves or portions which are releasably attached to each other. One half or portion of the housing has a plurality of protruding pins, and the other half or portion of the housing has a plurality of camming slots located and sized to slidably receive the pins. Movement of one half of the housing relative to the other half serves to latch or unlatch the housing.

In yet another embodiment of the present invention, the portable flashlight may further include a number of seals disposed between the halves of the housing, and between the lens and the housing. This embodiment of the flashlight may further includes an on/off switch disposed within the housing, and a seal formed to the switch and the housing. These seals provide, in combination with one another, a substantially water-tight construction.

The portable flashlight of the present invention utilizes a low-profile housing and provides a well collimated beam of light. A preferred embodiment of the present invention further provides a carrying handle that may be indexed into place and locked to function as a stand against a flat surface. The housing is easily disassembled and reassembled by rotating one-half relative to the other half, utilizing a simple camming mechanism.

These, as well as other advantages of the present invention will become more apparent from the following description and drawings. It is understood that changes in the specific structure shown and described may be made within the scope of the claims without departing from the spirit of the invention.

Figure 1:
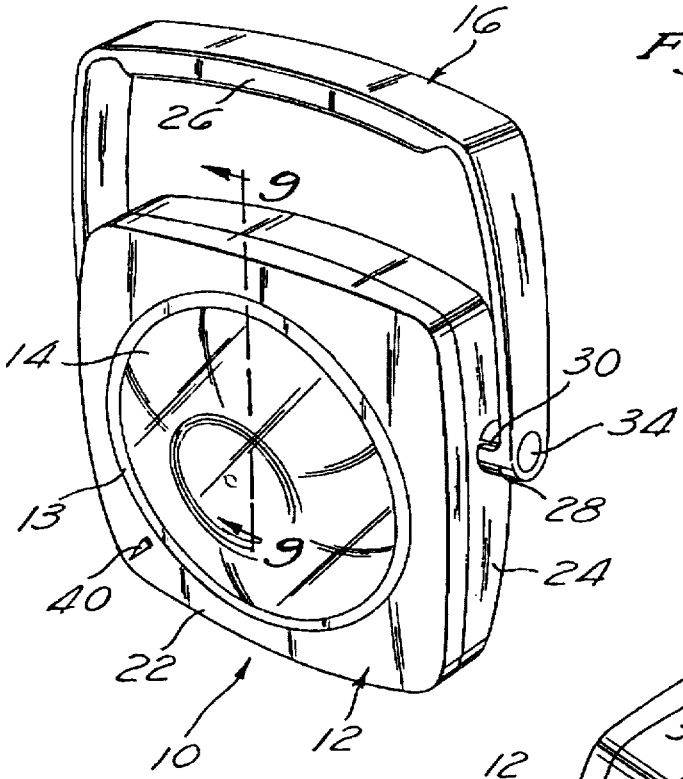
FIG. 1 is a perspective view of a portable flashlight of the present invention, with the handle in a carrying position.
Figure 5:
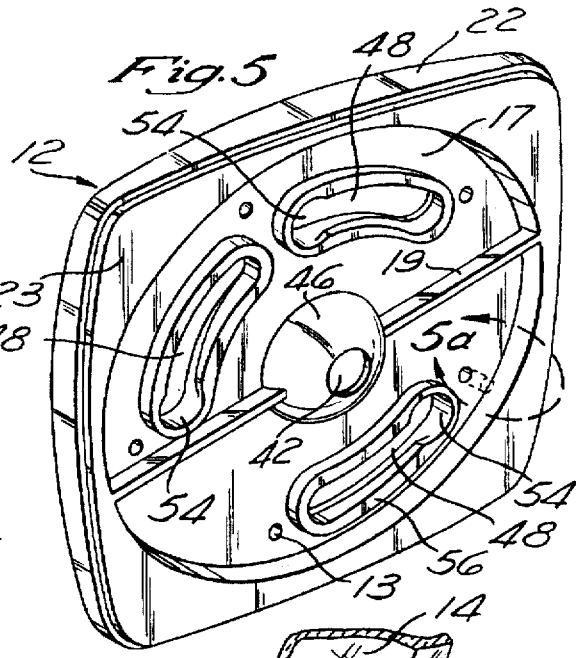
FIG. 5 is a reverse angle perspective view of the first half of the housing shown in FIG. 4.
Figure 6:
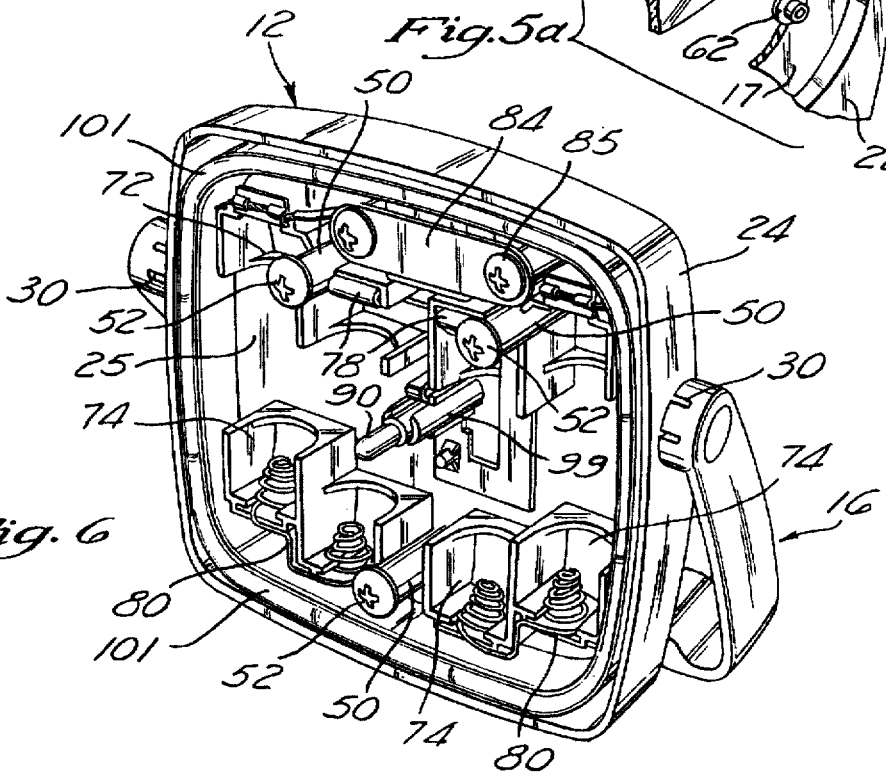
Figure 7:
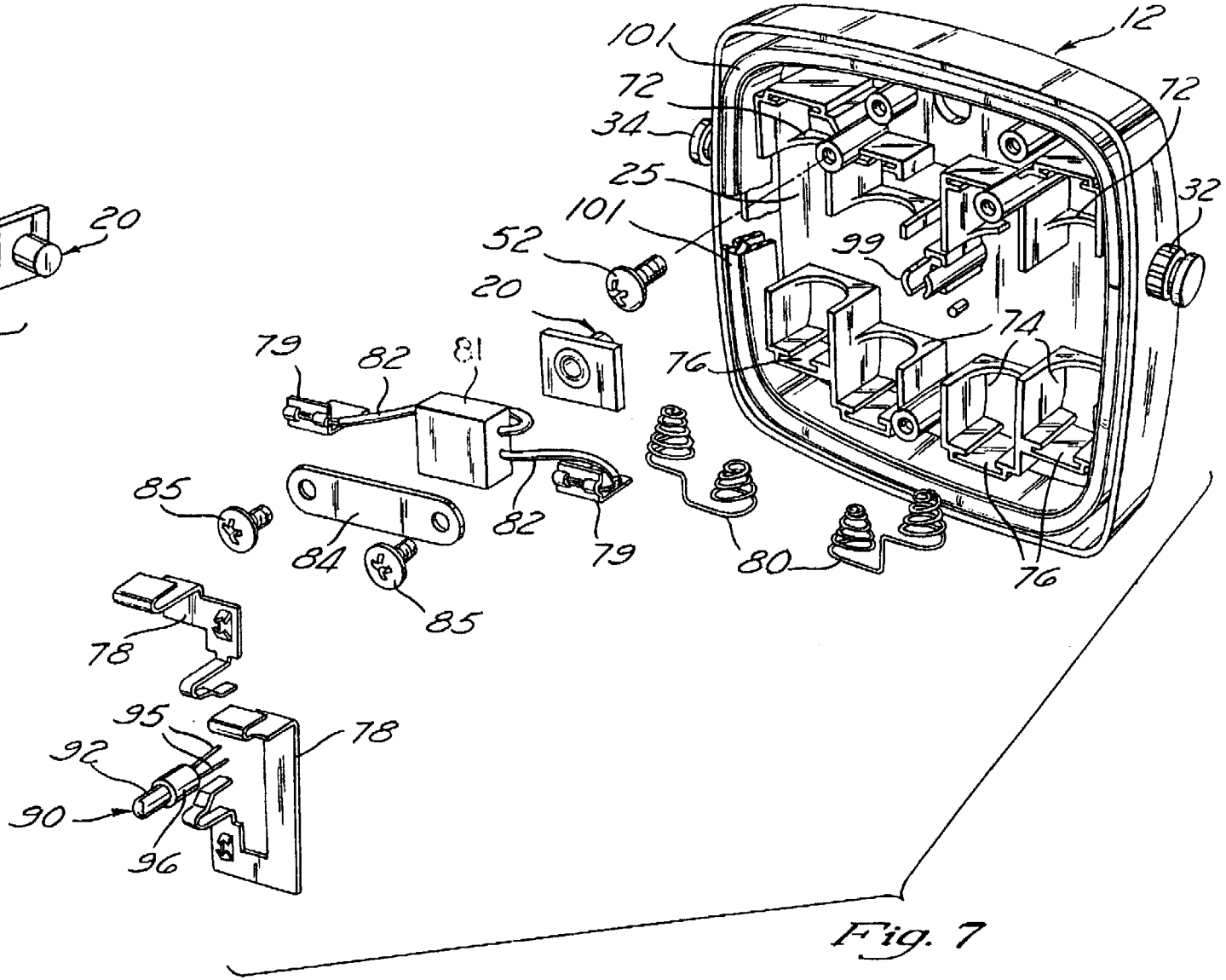
Figure 8:
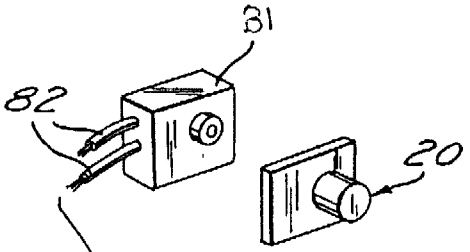
Figure 9:
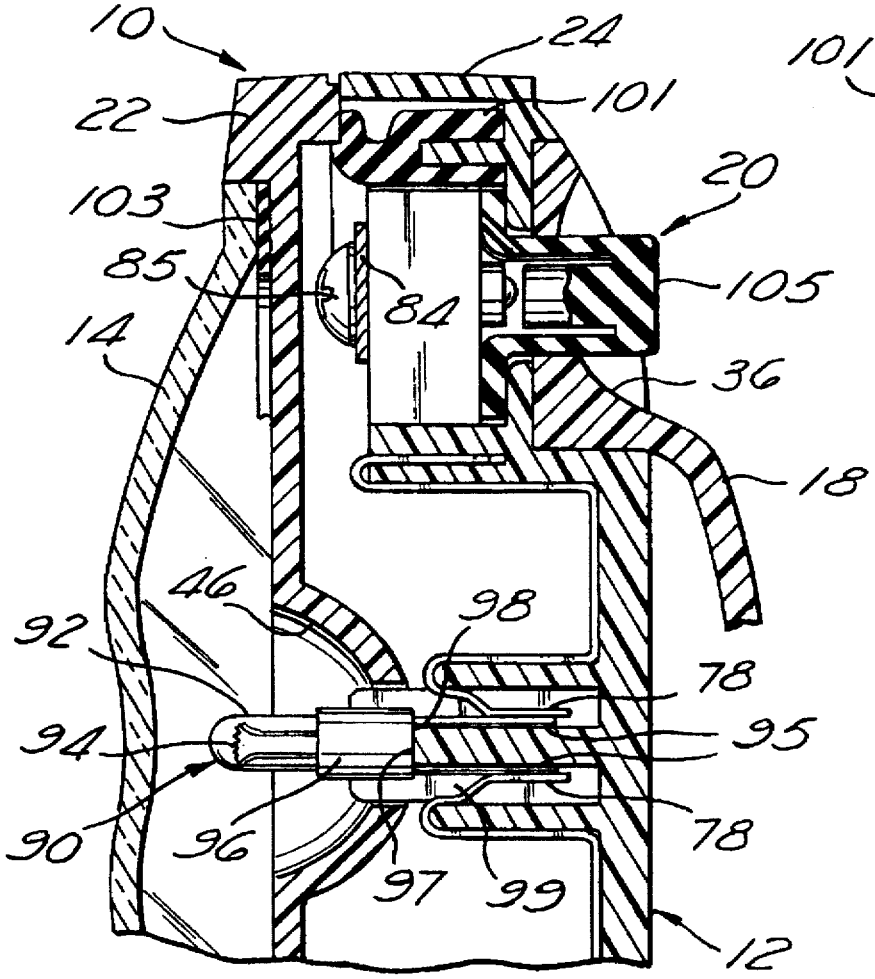
Figure 10:
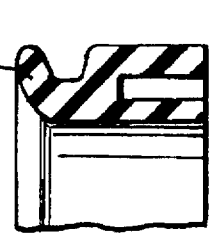

FIG. **5*a* is a detailed view of a portion of the housing of FIG. 5** showing the ramped cam mechanism thereof;

FIG. 6 is a perspective view of the second half of the housing of the flashlight of FIG. 1;

FIG. 7 is an exploded perspective view of the electrical connections of the flashlight;

FIG. 8 is an exploded perspective view of the on/off switch of the flashlight;

FIG. 9 is a cross-sectional view of a portion of the flashlight of FIG. 1 showing the on/off switch and the light source of the flashlight; and FIG. 10 is a cross-sectional view of a portion of the flashlight of FIG. 1 showing the seal which is disposed between the two halves of the housing.

DETAILED DESCRIPTION OF THE PREFERRED EMBODIMENT

The detailed discussion set forth below in connection with the appended drawings is intended as a description of the presently preferred embodiments of the invention, and is not intended to represent the only forms in which the present invention may be constructed or utilized. The description sets forth the functions and sequences of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 2:
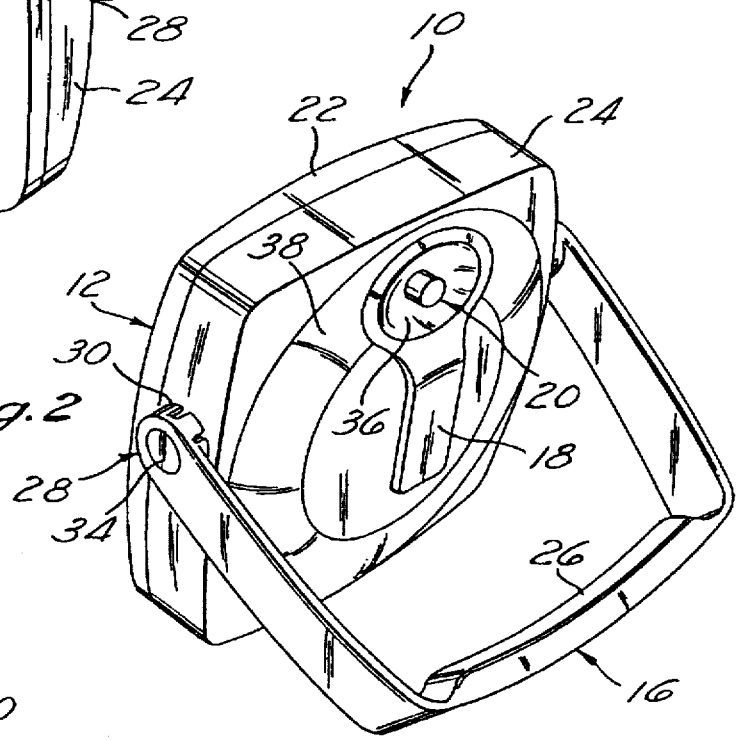
FIG. 2 is a reverse angle perspective view of the portable flashlight of FIG. 1, with the handle serving as a stand.
Figure 3:
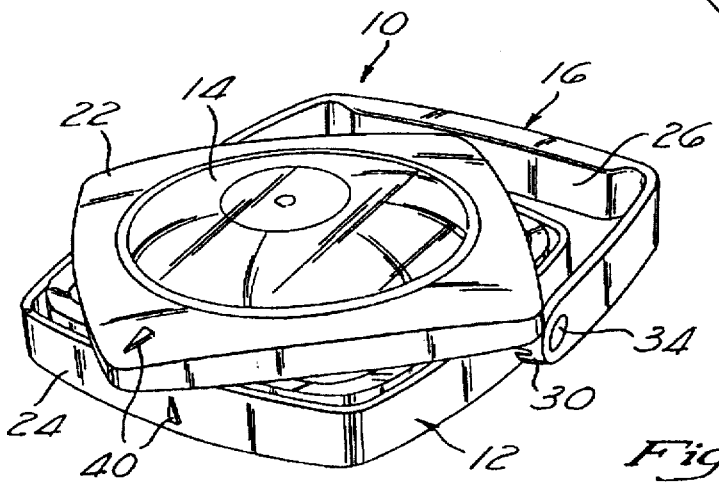
FIG. 3 is a perspective view of the flashlight of FIG. 1 in a state of partial disassembly.

The portable flashlight 10 of the present invention is illustrated in FIGS. 1–10 which depict a presently preferred embodiment of the invention. Referring now to FIGS. 1–3, the exterior of the portable flashlight 10 is comprised of a generally square-shaped housing 12 of a limited depth, a special lens 14 of a substantial width disposed within the housing 12 and a handle 16 attached to the housing 12. The portable flashlight 10 further includes a flexible clip 18 attached to the housing 12, and an on/off switch 20 disposed within the housing 12. The housing 12 has a first half 22 and a second half 24 which are releasably connected to each other. The structural components of the portable flashlight 10 are preferably fabricated of conventional molded plastic, offering the advantages of low weight and low cost. The lens 14 is preferably constructed in accordance with Applicant's U.S. Pat. No. 4,337,759, entitled RADIANT ENERGY CONCENTRATION BY OPTICAL TOTAL INTERNAL REFLECTION, the disclosure of which is expressly incorporated herein by reference.

Next, details of the construction of the exterior of the portable flashlight 10 may be more fully described. Referring to FIG. 1, the handle 16 includes a grip 26 to provide an increased surface area for holding the handle 16 while carrying the portable flashlight 10. The attachment of the handle 16 is formed to the housing 12 with a multi-position detent having six teeth 30. An axial pin 34 is formed in each side of the second half 24 of the housing 12 (see FIG. 7). Each axial pin 34 has plural grooves 32 operative to engage the teeth 30 within the handle 16. Referring to FIG. 2, a recessed area 36 is formed in the rear surface 38 of the second half 24 of the housing 12. The on/off switch 20 is mounted to extend within the recessed area 36, so as to minimize protrusion beyond the rear surface 38 of the housing 12.

Figure 4:
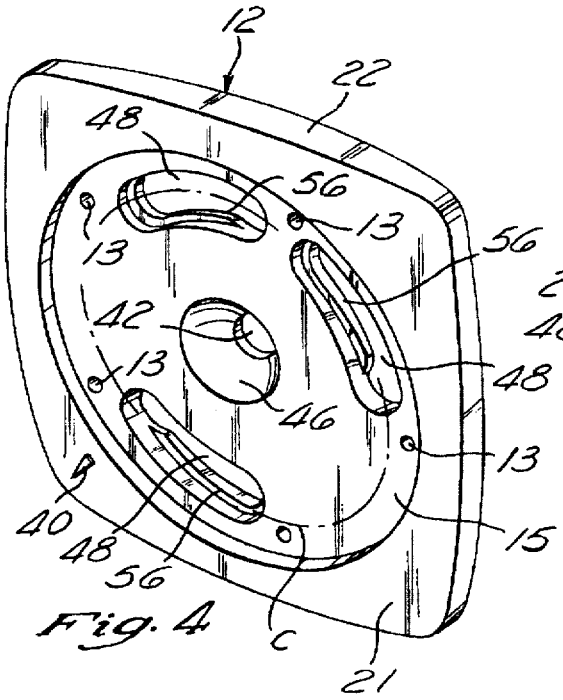
FIG. 4 is a perspective view of the first half of the housing of the flashlight of FIG. 1, showing the presence of slotted cam grooves therein.
Figure 5A:
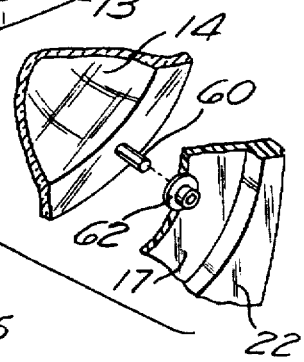

Now referring to FIGS. 4–6, the configuration of the interior of the housing 12 of the preferred embodiment of the portable flashlight 10 may be described. The forward side 21 of the first half 22 of the housing 12 is shown in FIG. 4, with the lens 14 removed. The plural mounting holes 13 for the lens 14 are evident, as well as the recessed surface 15. FIG. 5*a* shows how the lens 14 is held in the first half 22 of the housing 12. Plural pins 60 are formed on the lens 14 and pass through the mounting holes 13 to be secured by the retainers 62. FIG. 5 shows the aft side 23 of the first half 22 of the housing 12, having a recessed surface 17 and a hold-down rib 19. A clearance opening 42 is formed in the first half 22 of the housing 12 for a lightbulb 90 (see FIG. 6). Surrounding the opening 42 is a spherical dish or reflector portion 46 with highly reflective material formed thereon.

Also referring to FIGS. 4–6, the ramped camming groove mechanism connecting the two halves 22 and 24 of the housing 12 may be described. The first half 22 has three camming slots 48 which are arranged in a circular pattern about the opening 42, the slots 48 following a circular centerline c. Three cylindrical bosses 50 are formed in the second half 24 of the housing 12 corresponding to the slot 48 locations. Each cylindrical boss 50 has a bore formed therein to receive a retaining screw 52. Each of the slots 48 on the aft side 23 has an entry opening 54 sized to allow passage of the head of the retaining screw 52 therethrough. Within each of the slots 48 is a ramped surface portion of groove 56 that the head of the retaining screw 52 rides upon.

FIGS. 6 and 7 illustrate the electrical components inside the housing 12 of the preferred embodiment of the portable flashlight 10 of the present invention. Four sets of upper and lower support ribs 72 and 74 are formed to the inside surface 25 of the second half 24 of the housing 12, to support four "A—A" sized batteries (not shown). The upper and lower support ribs 72 and 74 each have contact slots 76 to hold spring barb contacts 78 (inboard) and 79 (outboard) and the spring contacts 80. The contacts 78, 79, and 80 are electrically connected with the batteries and switch 20 to form an electrical circuit.

Now referring to FIGS. 7–9, the parts of the on/off switch 20 may be described. The electric switch 81 is a conventional single pole, double throw switch. A pair of wires 82 connect the switch 81 to the outboard barb contacts 79. A strap 84 and a pair of screws 85 hold the electric switch 81 in place against the inside surface 25 of the housing 12.

Referring to FIGS. 7 and 9, the lightbulb 90 of the preferred embodiment of the portable flashlight 10 may be described. The lightbulb 90 has a lamp portion 92 having a substantially horizontal filament 94. The lightbulb 90 further has a shoulder portion 96 having a substantially flat end 98. Protruding from the flat end 98 are a pair of wires 95 which electrically connect to the inboard barb contacts 78. The shoulder portion 96 of the lightbulb 90 is held in place by a socket 99 formed into the inside surface 25 of the housing 12. The socket 99 has a substantially flat end 97 against which bears the flat end 98 of the shoulder portion 96. The net result is to locate the filament 94 at the focal point on the lens 14. When the lightbulb 90 is properly engaged in the socket 99, the lightbulb 90 portion 92 thereof is centrally positioned at the focal point of the lamp dish 46.

Now referring to FIGS. 9 and 10, the water-tight construction of the preferred embodiment of the portable flashlight 10 of the present invention may be described. The main seal 101 is generally square-shaped and disposed between the first half 22 and the second half 24 of the housing 12. A lens seal 103 is annular shaped and disposed between the lens and the first half 22 of the housing 12. A switch seal 105 is hat shaped and disposed around the electric switch 81 and between the second half 24 of the housing 12. The seals 101, 103, and 105 are fabricated of a pliable rubber-like material as commonly used for conventional gasket seals.

Now the operation of the preferred embodiment of the portable flashlight 10 of the present invention may be described. The first step of using the portable flashlight 10 may be the installation of four "A—A" sized batteries (not shown). To install the batteries, the two halves 22 and 24 of the housing 12 are separated to provide access. A simple 45-degree turn of the first half 22 relative to the second half 24 enable the housing 12 to be opened. The cylindrical bosses 50 ride through the slots 48 with the retaining screws 52 riding along the ramped grooves 56, causing a small gap to develop between the two halves 22 and 24 of the housing 12. This takes the pressure off the main seal 101, and the seal 101 moves to a relaxed position (see FIG. 10). When the retaining screws 52 reach the entry opening 54 of the slots 48, the two halves of the housing 12 may be separated by pulling the cylindrical bosses 50 and retaining screws 52 through the entry openings 54.

Once the housing 12 is opened, four "A—A" sized batteries may be installed in the second half 24 of the housing 12 in the forward and aft support cradles 72 and 76. It should be noted that the spring contacts 80 are uniquely adapted to facilitate both the positive as well as the negative terminals of the batteries. Then the portable flashlight 10 may be reassembled by reversing the steps involved in disassembly. The reassembly of the housing 12 is begun by aligning the two halves 22 and 24 at indicating marks 40 (FIG. 3). Rotating the first half 22 relative to the second half 24 on the ramped grooves 56 inside the camming slots 48 causes the first half 22 to bear against the main seal 101. The ribs 19 in the aft side 23 progressively wipe the lip of seal 101, positioning the first half 22 and preventing shearing of the seal 101 during rotational movement. The seal 101 is deformed (FIG. 9) closing off the housing 12 interior to water.

Upon pressing the on/off switch 20 one time, the single pole, double throw switch 81 is turned on, thereby opening the circuit between the pair of wires 82, which allows electricity to flow from the batteries through the contacts 78, 79, and 80 to the lightbulb 90. Pressing the on/off switch 20 again opens the circuit and cuts off the power supply from the lightbulb 90.

The handle 16 may be rotated into a carrying position, as shown in FIG. 1, or into a position to function as a stand for the portable flashlight 10, as shown in FIG. 2. Alternatively, the portable flashlight 10 may be supported on the belt or shirt pocket of the user through use of the clip 18.

It is understood that the portable flashlight 10 described herein and shown in the drawings represents only a presently preferred embodiment of the invention. Indeed, various modifications and additions may be made to the embodiment without departing from the spirit and scope of the invention. These modifications and additions may be obvious to those skilled in the art and may be implemented to adapt the present invention for use in a variety of different applications.

What is claimed is:

1. A portable flashlight, comprising:

a housing including:

a first half having a plurality of camming slots disposed therein; and a second half having a plurality of bosses disposed thereon;

said first and second halves being attachable to each other via the insertion of the bosses into respective ones of the camming slots and the movement of the first half in a latching direction relative to the second half, and detachable from each other via the movement of the first half in an unlatching direction relative to the second half and the removal of the bosses from within the camming slots;

a lens attached to the housing;

a light source disposed within the housing; and a first seal disposed between the first and second halves;

the camming slots and the bosses being configured in a manner wherein the movement of the first half in the latching direction subsequent to the insertion of the bosses into the camming slots facilitates the compression of the first seal between the first and second halves so as to form a water-tight seal therebetween.

2. The portable flashlight of claim 1 wherein:

each of the camming slots defines a ramped surface portion; and each of the bosses includes a retaining member attached thereto;

said retaining members moving along respective ones of the ramped surface portions when the first half is moved in the latching and unlatching directions relative to the second half subsequent to the insertion of the bosses into the camming slots.

3. The portable flashlight of claim 2 wherein each of the camming slots further defines a clearance hole portion for accommodating the retaining member of a respective one of the bosses, said clearance hole portions allowing for the insertion of the bosses into the camming slots and the removal of the bosses from within the camming slots.

4. The portable flashlight of claim 1 wherein said camming slots are arcuately contoured and extend about a circular center line, with the movement of the first half in the latching and unlatching directions being facilitated by the rotation thereof relative to the second half.

5. The portable flashlight of claim 1 wherein said first half further comprises at least one rib portion which is adapted to wipe and prevent the shearing of the first seal during the movement of the first half in the latching and unlatching directions relative to the second half subsequent to the insertion of the bosses into the camming slots.

6. The portable flashlight of claim 1 further comprising:

a power source disposed within said housing;

a switch attached to said housing and electrically connecting said power source to said light source;

a second seal disposed between said lens and said housing; and a third seal disposed between said switch and said housing;

said first, second and third seals providing said portable flashlight with a substantially water-tight construction.

* * * * *